US006862976B2

(12) United States Patent
Gaiser et al.

(10) Patent No.: US 6,862,976 B2
(45) Date of Patent: Mar. 8, 2005

(54) MONOBLOC PISTON

(75) Inventors: Randall R. Gaiser, Chelsea, MI (US); Xiluo Zhu, Ann Arbor, MI (US); Roberto Bueno Nigro, Ann Arbor, MI (US)

(73) Assignee: Federal-Mogul World Wide, Inc., Southfield, MI (US)

( * ) Notice: Subject to any disclaimer, the term of this patent is extended or adjusted under 35 U.S.C. 154(b) by 362 days.

(21) Appl. No.: 10/253,785

(22) Filed: Sep. 24, 2002

(65) Prior Publication Data

US 2003/0075042 A1 Apr. 24, 2003

Related U.S. Application Data

(60) Provisional application No. 60/355,693, filed on Oct. 23, 2001.

(51) Int. Cl.[7] ..... F01B 31/08
(52) U.S. Cl. ..... 92/186; 92/231
(58) Field of Search ..... 92/186, 208, 231

(56) References Cited

U.S. PATENT DOCUMENTS

| | | | |
|---|---|---|---|
| 1,382,465 | A | 6/1921 | Bramberry |
| 1,772,215 | A | 8/1930 | Grant |
| 1,953,109 | A | 4/1934 | Heron |

(List continued on next page.)

FOREIGN PATENT DOCUMENTS

| | | |
|---|---|---|
| DE | 3032671 A1 | 3/1982 |
| DE | 243539 A1 | 9/1987 |
| JP | 07293326 | 11/1995 |
| WO | WO9620340 | 7/1996 |

OTHER PUBLICATIONS

"Basis Features of Good Piston Design" Automative Industries, (May 1, 1954) pp 54–056, 106.*

Piston Design for High Combustion Pressures and Reduced Heat Rejection to Cooland– 820505—Erich Wacker and Wilfried Sander– 0148–7101/82/0222–0505.

*Primary Examiner*—F. Daniel Lopez
(74) *Attorney, Agent, or Firm*—Howard & Howard

(57) ABSTRACT

A monobloc piston has at least two steel parts welded together to define an inner cooling gallery. An outer ring belt is spaced from an inner annular support wall and is joined by a combustion bowl and a lower wall. A pair of pin bosses have axially aligned pin bores. A skirt is formed as one immovable piece with the pin bores. The piston has the following dimensional relationships:

ISMD=42–55% of BD, where ISMD is a mean diameter on the inner support wall and BD is an outer diameter of the ring belt wall, ISW=3–8% of BD, where ISW is a sectional width of the inner support wall, CH>53% of BD where CH is a compression height measured between the pin bore axis and the upper surface, TLH>4% of BD, where TLH is a top land height measured between the top of the upper ring groove and the upper surface, SL=30–80% of BD, where SL is a length of the skirt measured between the upper and lower ends of the skirt, SW=2.5–6.5% of BD, where SW is a thickness of the skirt, and GV=150–250% of $BD^2$ and 5–20% of $BD^2 \times CH$, where GV is a volume of the oil gallery.

2 Claims, 3 Drawing Sheets

U.S. PATENT DOCUMENTS 2,000,000 A 4/1935 Ledwinka
2,244,166 A 6/1941 Marien
2,442,408 A 6/1948 Graham
2,608,452 A 8/1952 Hollingsworth
2,771,327 A 11/1956 Reinberger
3,104,922 A 9/1963 Baster
3,585,293 A 6/1971 DeBiasse
3,613,521 A 10/1971 Itano
3,654,840 A 4/1972 Elliott
4,011,797 A 3/1977 Cornet
4,103,594 A 8/1978 Geffroy
4,161,165 A 7/1979 Belush et al.
4,213,438 A 7/1980 Elsbett et al.
4,286,505 A 9/1981 Amdall
4,581,983 A 4/1986 Moebus
4,741,543 A 5/1988 Geffroy et al.
4,747,340 A 5/1988 Schellmann et al.
4,838,149 A 6/1989 Donnison et al.
4,989,559 A 2/1991 Fletcher-Jones
5,040,454 A * 8/1991 Ballheimer et al. ..... 92/186
5,067,393 A 11/1991 Kawasaki et al.
5,074,264 A 12/1991 Mielke
5,172,626 A 12/1992 Hart
5,201,805 A 4/1993 Schubert
5,253,877 A 10/1993 DeBiasse et al.
5,359,922 A 11/1994 Martins Leites et al.
5,474,307 A 12/1995 DeBiasse et al.
5,709,184 A 1/1998 Ali
6,026,777 A 2/2000 Kemnitz et al.
6,155,157 A 12/2000 Jarrett
6,260,472 B1 7/2001 Zhu et al.

* cited by examiner

MONOBLOC PISTON

The disclosure claims priority of provisional application No. 60/355,693, filed Oct. 23, 2001, whose priority is claimed for this application.

BACKGROUND OF THE INVENTION

1. Technical Field

This invention relates generally to pistons used in diesel engine applications.

2. Related Art

The requirement that modern diesel engines be manufactured with improved emission control has resulted in diesel engines being made with ever increasing cylinder pressures. In such diesel engines, the pressure can reach as high as 300 bar cylinder pressure, which enables the engine to maintain current power levels and fuel economy while meeting the strict emission requirements. The increased cylinder pressure of modern diesel engines has placed an increased demand on the structural integrity, cooling effectiveness, and performance of diesel engine pistons which reciprocate in the piston cylinders to generate power. Some diesel engine pistons which once performed satisfactorily are unable to meet the increased demands of the modern diesel engine.

It is an object of the present invention to improve on conventional diesel engine pistons that can perform satisfactorily under the increased demands of the modern diesel engine.

SUMMARY OF THE INVENTION

A monobloc piston constructed according to a presently preferred embodiment of the invention includes a piston body fabricated of at least two steel parts joined by a weld joint. The piston body has an outer annular ring belt wall extending between an upper surface of the piston body and a lower region of the ring belt wall spaced from the upper surface. A plurality of ring grooves are formed in the ring belt wall and include an upper ring groove having a top edge. A combustion bowl is formed in the upper surface and defined in part by a combustion bowl wall. An inner annular support wall is spaced radially inwardly from the outer ring belt wall and is joined to the outer ring belt wall and upper end by the combustion bowl wall and at a lower end by a lower wall defining an internal oil gallery between the walls. A top of the oil gallery extends above the top edge of the upper ring groove. A pair of depending pin bosses have pin bores aligned along a pin bore axis. A piston skirt is formed as one immovable piece with the pin bosses having upper and lower surfaces. The piston has the following dimensional relationships:

ISMD=42–55% of BD, where ISMD is a mean diameter on the inner support wall and BD is an outer diameter of the ring belt wall, ISW=3–8% of BD, where ISW is a sectional width of the inner support wall, CH>53% of BD where CH is a compression height measured between the pin bore axis and the upper surface, THL>4% of BD, where TLH is a top land height measured between the top of the upper ring groove and the upper surface, SL=30–80% of BD, where SL is a length of the skirt measured between the upper and lower ends of the skirt, SW=2.5–6.5% of BD, where SW is a thickness of the skirt, and GA=150–250% of $BD^2$ and GV=5–20% of $BD^2 \times CH$, where GA is the area and GV is a volume of the oil gallery.

A piston manufactured according to the invention has the advantage of providing sufficient structural integrity, cooling effectiveness and performance that enables it to operate in modern diesel engines having cylinder pressures reaching as high as 300 bar.

The piston has the further advantage of providing such a high performance piston in a compact, material efficient construction.

BRIEF DESCRIPTION OF THE DRAWINGS

These and other features and advantages of the present invention will become more readily appreciated when considered in connection with the following detailed description and appended drawings, wherein.

DESCRIPTION OF THE PREFERRED EMBODIMENT

Figure 1:
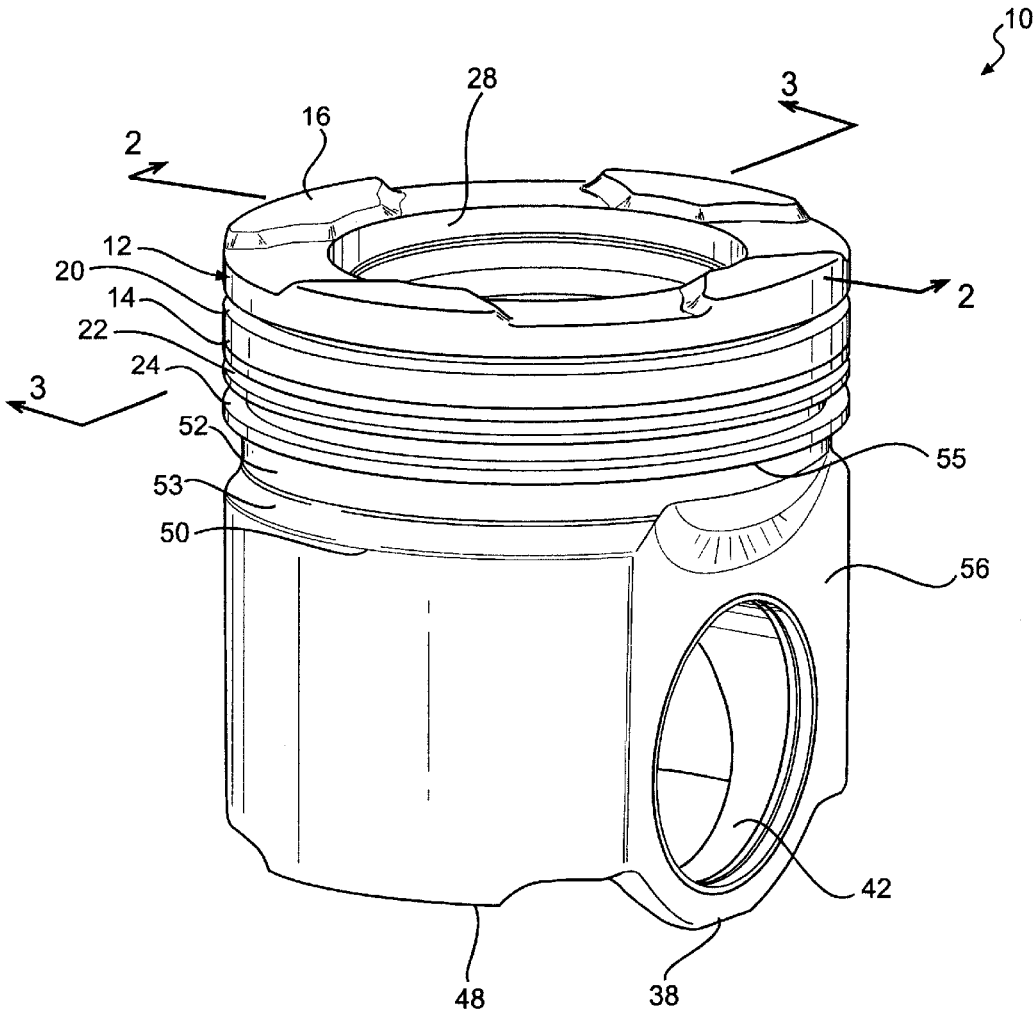
FIG. 1 is a perspective view of a piston constructed according to a presently preferred embodiment of the present invention.
Figure 2:
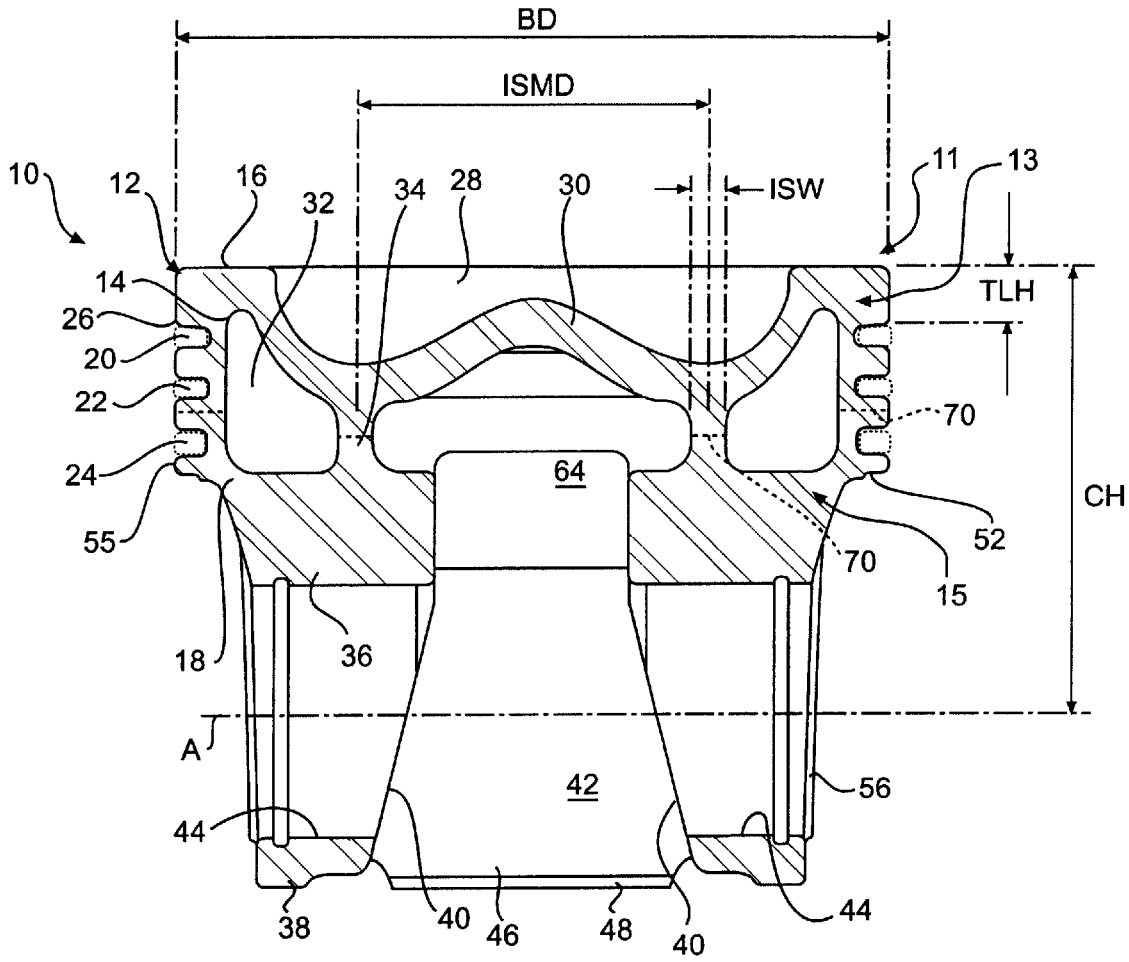
FIG. 2 is a cross-sectional view taken along lines 2—2 of FIG. 1.
Figure 3:
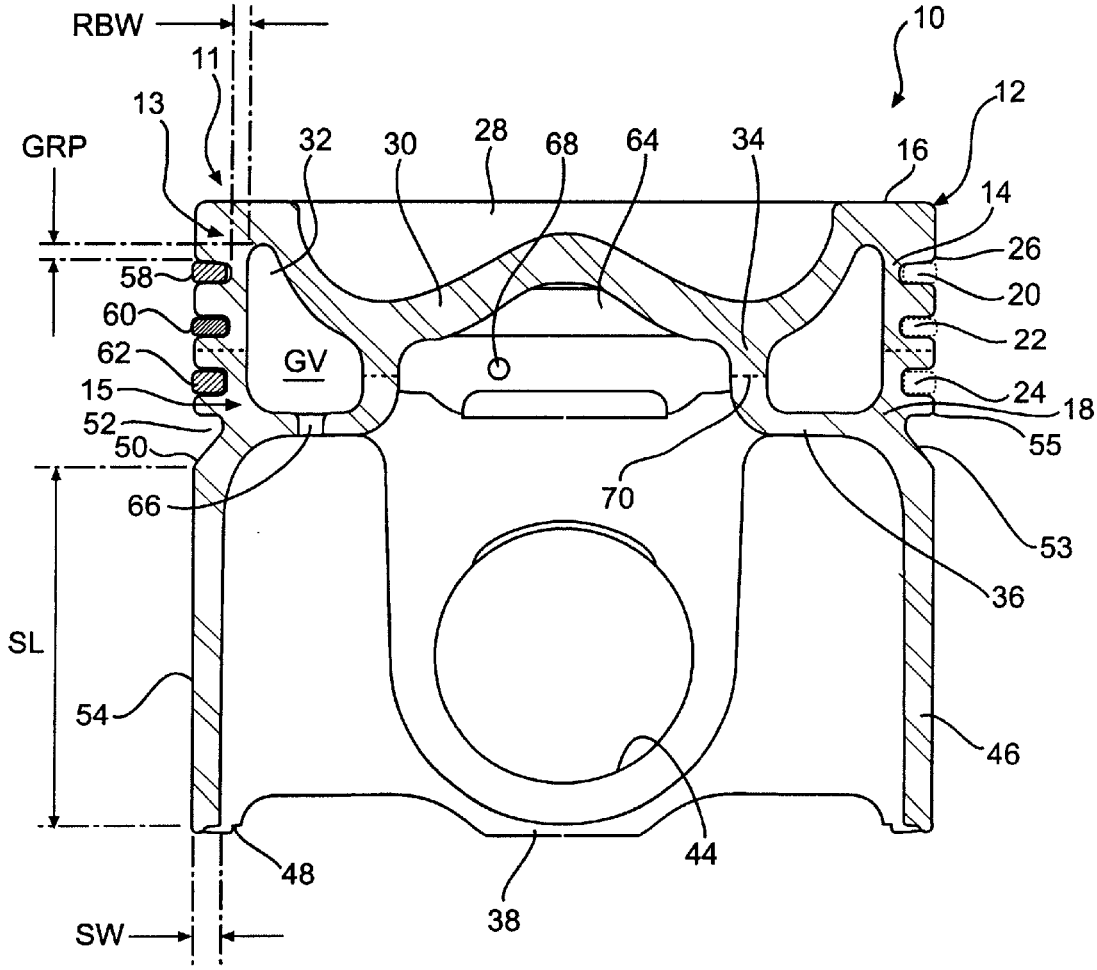
FIG. 3 is a cross-sectional view taken along lines 3—3 of FIG. 1.

FIGS. 1–3 show a closed gallery monobloc piston generally at 10 constructed according to a presently preferred embodiment of the invention, and includes a piston body 11 fabricated of at least two parts 13, 15 welded together across a weld joint 70 to define an internal oil cooling gallery 32 of the piston body 11. The piston body 11 includes an upper head portion 12 having an outer generally cylindrical ring belt 14 extending between an upper face or surface 16 of the head portion 12 and a lower region 18 spaced from the upper face 16. The ring belt 14 is formed with a plurality of ring groves 20, 22 and 24 machined into an outer surface 26 of the ring belt 14. The outer surface 26 has a predetermined diameter BD, designated as the bore diameter in FIGS. 2 and 3. As shown best in FIG. 2, the wall of the ring belt 14 has a predetermined thickness or width, designated RBW, corresponding to the thickness of the ring belt wall inwardly from the base of the ring grooves 20, 22 and 24.

The head portion 12 is formed with a combustion bowl 28 machined into the upper face 16 of the head portion 12 radially inwardly form the ring belt 14 and presenting a contoured combustion bowl wall 30. The head portion 12 has a predetermined top land height designate TLH, measured form the top of the upper ring groove 20 and the upper surface 16 as shown in FIG. 2.

The piston 10 has an internal, annular oil gallery 32 having an outer wall defined in part by the ring belt 14 and upper wall defined by the combustion bowl wall 30. The oil gallery 32 is further bound by an inner annular support wall 34 which is spaced radially inwardly from the ring belt 14 and extends between the combustion bowl wall 30 and a lower circumferentially extending wall 36 which further extends between the inner support wall 34 and ring belt 14 in spaced relation to the combustion bowl wall 30 and closes off the bottom of the oil galley 32. The inner support wall 34 has a predetermined inner support wall width, designated ISW, and defines an inner support mean diameter, designated ISMD, of predetermined dimension as illustrated in FIG. 2. The top of the oil gallery 32 extends above the top of the upper ring groove 20 by a predetermined distance designated GRP in FIG. 3.

As shown best in FIG. 2, a pair of pin bosses 38 extend downwardly from the head portion 12 and have inner faces 40 which are spaced axially from one another to define a space 42 for receiving the upper end of a connecting rod therein. The pin bosses 38 are formed with aligned pin bores 42 along a pin bore axis A. The pin bores 44 receive a wrist pin (not shown) which couples the piston 10 to the connecting rod (not shown). The piston 10 has predetermined compression height, designated CH in FIG. 2, measured between the pin bore axis A and the top surface 16 of the head portion 12.

The piston 10 is formed with an integral piston skirt 46 formed as one immovable piece with the pin bores (i.e. is formed as a structural part or extension of the pin bores) which extends downwardly form the ring belt 14 of the head portion 12 and is coupled to each of the pin bosses 38 on opposite sides of the piston. The piston skirt 46 extends between a lower surface 48 and an upper surface 50. The skirt 46 has a predetermined skirt length, designated SL, measured between the lower and upper surface 48, 50 of the skirt, as shown in FIG. 2 and a predetermined skirt width, designated SW, as shown in FIG. 2. An oil groove 52 is machined into the outer surface 26 of the ring belt 14 adjacent its lower region 18, separating the outer surface 26 of the ring belt from an outer surface 54 of the skirt 46 and defining the upper surface 50 of the skirt 46. The groove 52 does not extend through to the gallery 32 nor to the interior of the skirt 46 and is preferably aligned radially with the bottom wall 36 of the gallery 32. The oil groove 52 extends circumferentially about the piston 10 but is interrupted in the region of the pin bosses 38, such that the oil groove 50 opens up to the recessed outer planar faces 56 of the pin bosses 38 as illustrated in FIG. 2, permitting any oil gathered in the oil groove 52 to drain downwardly back into the crank case across the region of the outer faces 56. As shown in FIG. 3, piston rings 58, 62 and 64 are accommodated in the ring grooves 20, 22, and 24, respectively, while the oil groove 52 is free of any piston rings.

The space 42 between the pin bores is open to the combustion bowl wall 30. Thus, there is a space 64 below the combustion bowl wall 30 and radially bound by the inner support wall 34 that is open to the space 42 between the pin bores. The oil gallery 32 is formed with one or more oil inlets, schematically shown at 66 in FIG. 2, that communicate with one or more corresponding oil jets (not shown) in operation of the piston for directing cooling oil into the oil gallery 32 to cool the surrounding walls of the gallery 32 with a known "cocktail-shaker" action of the oil as a result of the reciprocating movement of the piston 10 in operation. Oil introduced to the oil gallery 32 is permitted to escape through one or more discharge ports, schematically shown at 68 in FIG. 3, into the inner space 64 for drainage back into the crack case (not shown).

To form the closed oil gallery 32, the piston 10 may be initially formed from two or more component parts machined with the oil gallery features which are subsequently joined to one another to form the closed gallery 32 in a subsequent joining operation. In the illustrated embodiment, the piston 10 is formed from separate upper and lower crown parts which are joined by welding, and preferably by friction welding, across weld joint 70, shown in FIG. 2.

The piston 10 is fabricated of steel and has the following dimensional relationships that enable the piston to operate successfully under high cylinder pressures in the vicinity of 300 bar;

ISMD=42–55% of BD

The position of the inner support wall 34 is critical to supporting the combustion bowl wall 30 under extreme pressures without introducing unwanted bending moments.

ISW=3–8% of BD

The section of the inner support wall 34 is critical to sustain the buckling loads imparted by the high pressure, but must not be too wide so as to allow conduction of heat to the pin bores 38.

CH>53% of BD

This dimensional relationship is necessary in order to enable the piston to be formed as two parts and subsequently friction welded.

TLH>4% of BD

TLH values less than 4% impart excessively high temperatures to the top ring groove 20.

GRP>0

In order to provide sufficient cooling to the top ring groove 20, it is necessary for the oil gallery 32 to extend above the top of the upper ring groove 20.

SL=30–80% of BD

This dimensional relationship assures that the piston skit provides sufficient guidance and load carrying capacity and acceptably low friction levels.

SW=2.5–6.5 of BD

This dimensional relationship assures that the skirt is sufficiently strong to withstand the loads imparted to it while maintaining adequate flexibility during operation of the piston.

GA=150–250% of $BD^2$ and GV is 5–20% of $BD^2 \times CH$

This area and volumetric relationship assures that the cooling gallery is sufficiently large to carry enough oil to adequately cool the piston during operation.

Obviously, many modifications and variations of the present invention are possible in light of the above teachings. It is, therefore, to be understood that within the scope of the appended claims, the invention may be practiced otherwise than as specifically described. The invention is defined by the claims.

What is claimed is:

1. A monobloc piston, comprising:

a piston body fabricated of at least two steel parts joined by a weld joint, said piston body having an outer annular ring belt wall extending between an upper surface of the piston body and a lower region of the ring belt wall spaced from the upper surface;

a plurality of ring grooves formed in said ring belt wall including an upper ring groove having a top edge;

a combustion bowl formed in the upper surface of said body portion and defined in part by a combustion bowl wall;

an inner annular support wall spaced radially inwardly of the outer ring belt wall and joined to said outer ring belt wall at an upper end by said combustion bowl wall and at a lower end by a lower wall and defining an internal oil gallery between said walls, a top of said oil gallery extends above said top edge of said upper ring groove;

a pair of depending pin bosses having pin bores aligned along a pin bore axis;

a piston skirt formed as one immovable piece with the pin bores having upper and lower surfaces; and said piston having the following dimensional relationships:

ISMD=42–55% of BD, where ISMD is a mean diameter on the inner support wall and BD is an outer diameter of the ring belt wall, ISW=3–8% of BD, where ISW is a sectional width of the inner support wall, CH>53% of BD where CH is a compression height measured between the pin bore axis and the upper surface, TLH>4% of BD, where TLH is a top land height measured between the top of the upper ring groove and the upper surface, SL=30–80% of BD, where SL is a length of the skirt measured between the upper and lower ends of the skirt, SW=2.5–6.5% of BD, where SW is a thickness of the skirt, and GA=150–250% of $BD^2$ and GV=5–20% of $BD^2 \times CH$, where GA is the area and GV is a volume of the oil gallery.

2. The monobloc piston of claim 1 wherein said weld joint comprises a friction weld joint.

* * * * *